US006978946B2

(12) United States Patent
Sweeton

(10) Patent No.: US 6,978,946 B2
(45) Date of Patent: Dec. 27, 2005

(54) DUAL DISCHARGE TRIGGER SPRAYER

(75) Inventor: Steve L. Sweeton, Lake Winnegabo, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 56 days.

(21) Appl. No.: 10/756,546

(22) Filed: Jan. 14, 2004

(65) Prior Publication Data

US 2005/0150977 A1 Jul. 14, 2005

(51) Int. Cl.[7] ..... A62C 11/00; A62C 13/62; A62C 13/66; A62C 31/00; B05B 9/043

(52) U.S. Cl. ..... 239/333; 239/303; 239/304; 239/490; 239/492; 222/383.1; 222/145.5; 222/136

(58) Field of Search ..... 239/333, 303, 239/304, 490, 492, 353, 358, 413, 414, 419, 239/419.3, 463, 468–470, 476, 487, 488, 239/491, 493, 506, 537, 538, 543, 548; 222/383.1, 222/145.5, 136

(56) References Cited

U.S. PATENT DOCUMENTS

| | | | | | |
|---|---|---|---|---|---|
| 3,628,733 | A | | 12/1971 | Kahn | 239/296 |
| 4,706,888 | A | | 11/1987 | Dobbs | 239/478 |
| 5,332,157 | A | * | 7/1994 | Proctor | 239/304 |
| 5,535,950 | A | | 7/1996 | Barriac et al. | 239/304 |
| 5,609,299 | A | * | 3/1997 | Foster et al. | 239/304 |
| 5,735,465 | A | | 4/1998 | Laforcade | 239/337 |
| 5,752,626 | A | | 5/1998 | Bachand | 222/136 |
| 5,857,591 | A | | 1/1999 | Bachand | 222/1 |
| 5,887,761 | A | * | 3/1999 | Foster et al. | 239/304 |
| 5,901,883 | A | | 5/1999 | Ritsche | 222/137 |
| 5,996,847 | A | * | 12/1999 | Smolen et al. | 222/137 |
| 6,149,077 | A | | 11/2000 | Pohler | 239/337 |
| 6,550,694 | B1 | | 4/2003 | Foster et al. | 239/304 |
| 2003/0025001 | A1 | | 2/2003 | De Laforcade | 239/333 |
| 2003/0201339 | A1 | | 10/2003 | Foster et al. | 239/304 |
| 2003/0201342 | A1 | | 10/2003 | Foster et al. | 239/526 |

* cited by examiner

*Primary Examiner*—David A. Scherbel
*Assistant Examiner*—Darren Gorman
(74) *Attorney, Agent, or Firm*—Gordon & Jacobson, P.C.

(57) ABSTRACT

A trigger actuated fluid dispenser for simultaneously dispensing disparate fluids separately stored in separate fluid compartments of a container includes a mixing manifold for intimately mixing the fluids together and the nozzle assembly in which the mixture is channeled into a pair of spray nozzles through which the mixture of fluids issue as it sprays, upon simultaneous pumping of the disparate fluids by a single trigger actuator directing the disparate fluids along separate discharge paths to the mixing manifold.

10 Claims, 2 Drawing Sheets

DUAL DISCHARGE TRIGGER SPRAYER

BACKGROUND OF THE INVENTION

This invention relates generally to a dual discharge sprayer for simultaneously discharging different fluids separately stored in different fluid compartments, and more particularly to such a dispenser for simultaneously discharging a mixture of the different fluids through separate discharge spray nozzles.

U.S. Pat. No. 6,550,694 discloses a dual trigger sprayer which mixes different fluids in a common discharge passage prior to their being dispensed from the discharge passage as a spray through a single discharge opening. U.S. Pat. No. 5,535,950 likewise discloses a dual trigger sprayer for simultaneously discharging separately stored disparate fluids as a mixture prior to dispensing through a single spray discharge orifice. This patent further discloses a dual trigger sprayer for simultaneously dispensing disparate fluids separately stored through discharge passages and through a pair of separate spray discharge orifices for mixing together at or before reaching the target.

The need arises to assure intimate mixing of the fluids while discharging the mixture through separate discharge orifices to make the user aware of the spray discharge of two different fluids. Oftentimes, the user needs reminding that different fluids, such as water and a cleaning concentrate, are being sprayed. If the disparate fluids are mixed prior to discharge through a single orifice, the user may be confused, believing that only the single fluid is being sprayed. Otherwise, if the disparate fluids are separately sprayed through a pair of discharge orifices, the user is made aware of the spraying of disparate fluids except that the fluids may not be mixed satisfactorily after leaving the orifices.

SUMMARY OF THE INVENTION

It is therefore an object of the present invention to provide a dual trigger sprayer capable of simultaneously pumping different fluids stored separately through separate discharge passages and from the sprayer as a mixture through a pair of separate spray discharge orifices. Separate fluids pass through separate discharge passages and one-way discharge valves into a mixing manifold having a single discharge opening. A nozzle coupled to the manifold has a pair of separate spin mechanics assemblies through which the mixture is discharged as a pair of sprays upon pump actuation. The nozzle is mounted to the manifold for rotation between discharge open and closed positions.

Other objects, advantageous and novel features of the invention will become more apparent from the following detailed description of the invention when taken in conjunction with the accompanying drawings.

DETAILED DESCRIPTION OF THE INVENTION

Figure 2:
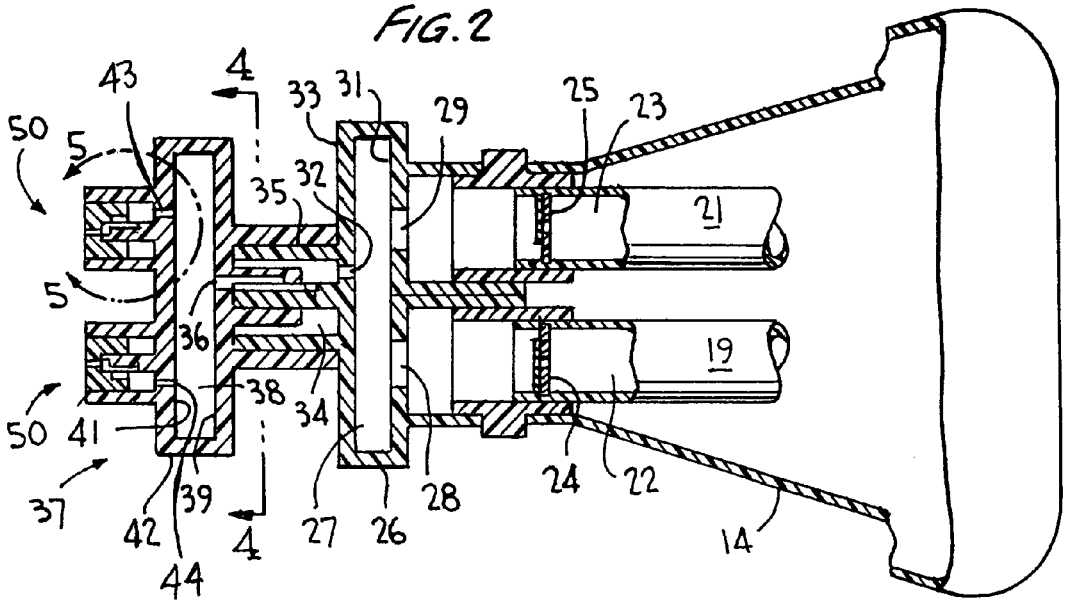
FIG. 2 is a partially cut-away, mostly sectional view taken substantially along the line 2—2 of FIG. 1.
Figure 1:
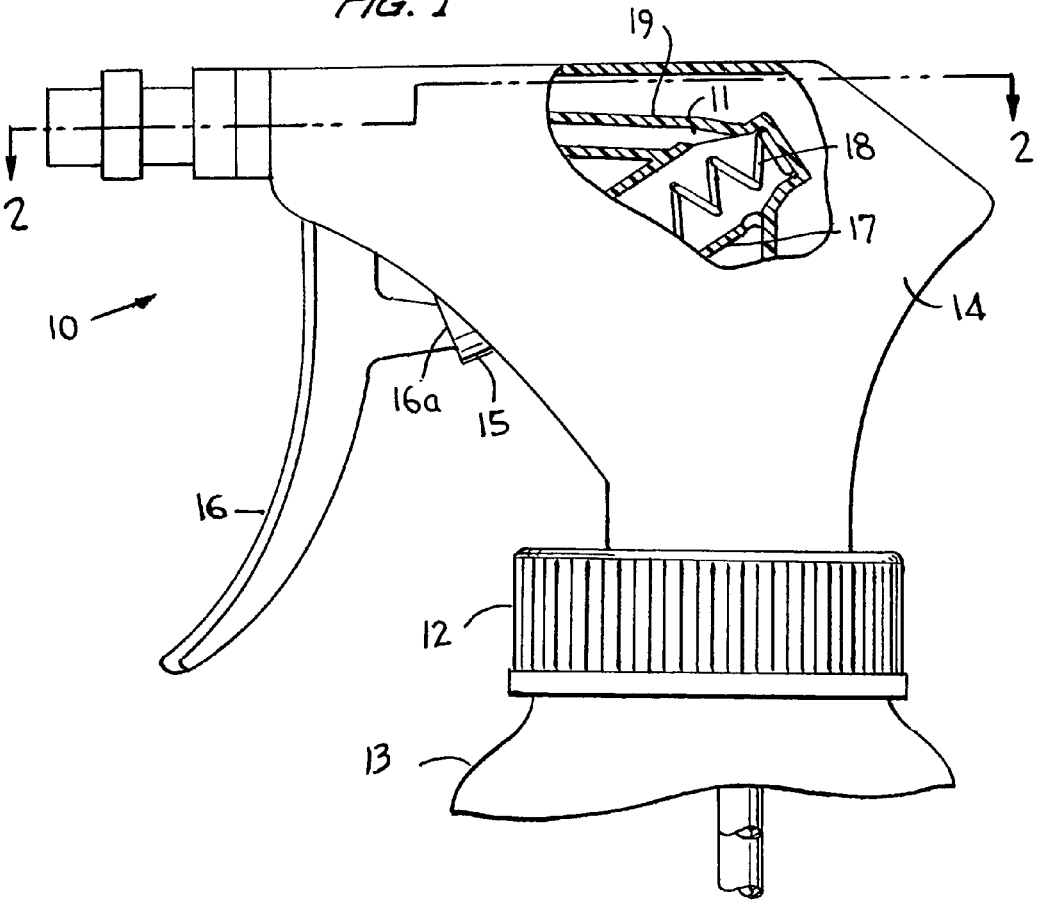
FIG. 1 is a side elevational view, partly in section, with a dual sprayer incorporating the invention.
Figure 3:
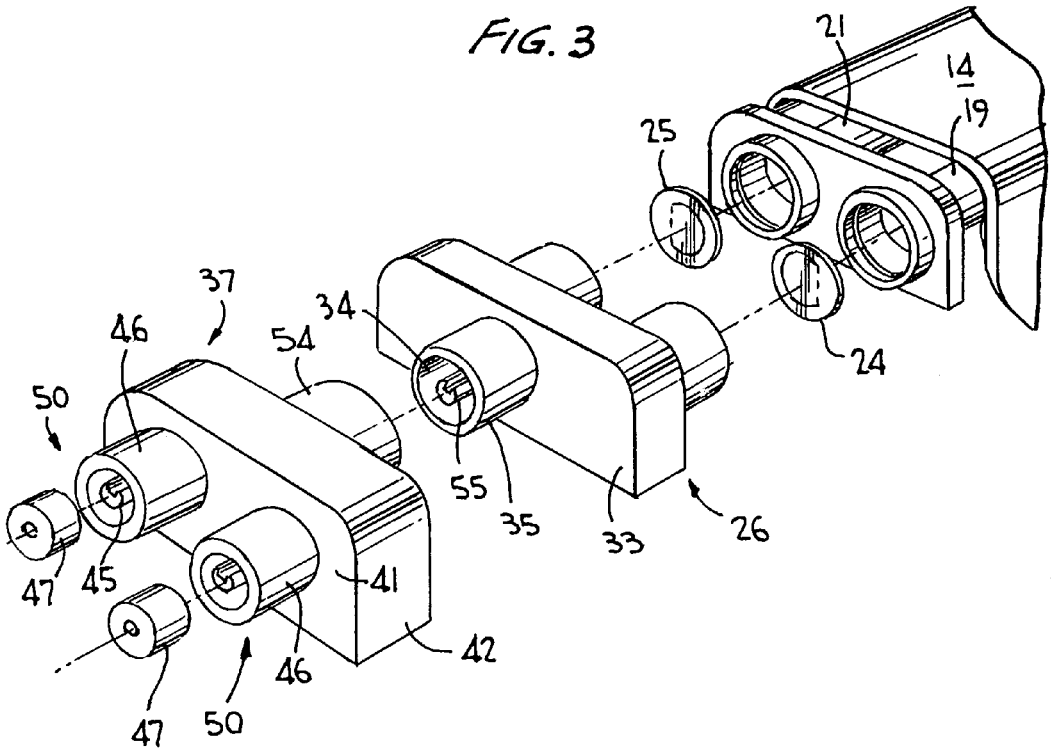
FIG. 3 is an expanded perspective view of the dual spray feature according to the invention.

Turning now to the drawings wherein like reference characters refer to like and corresponding parts throughout the several views, the dual trigger sprayer incorporating the invention is generally designated 10 in FIG. 1 as including a pump body 11 supporting a container closure 12 for mounting the dispenser to a dual compartmented container 13 of the type disclosed, for example, in U.S. Pat. No. 5,535,950, the entirety of the disclosure of which being specifically incorporated herein by reference. The pump body is covered by a shroud 14 and contains a pair of side-by-side pump pistons 15 (only one shown) operating in a pair of side-by-side pump cylinders 17 to define therewith variable volume pump chambers in known manner. A trigger actuator in the form of a single trigger lever 16 is hingedly mounted to the pump body in engagement with the pistons as at 16*a* for simultaneously reciprocating the pistons in their bores against the force of suitable return springs 18 (only one shown).

Figure 5:
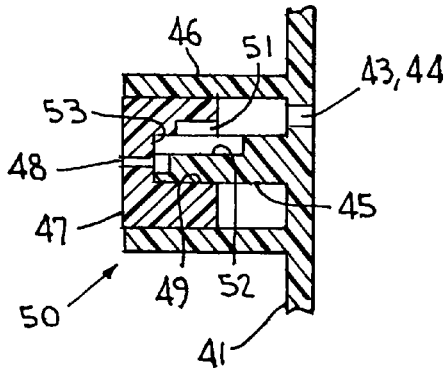
FIG. 5 is an enlarged detail view taken at arrow 5 of FIG. 2

The pump body further includes a pair of side-by-side discharge barrels 19, 21 respectively defining discharge passages 22, 23 through which disparate fluids stored in separate compartments in the container are pumped upon trigger actuation in the same manner as described in commonly owned 5,535,950. However, rather than mixing internally of the sprayer and issuing through a single discharge orifice in accordance with one embodiment of that patent, or instead of issuing through separate discharge orifices and mixing externally of the sprayer at or before hitting the target as in accordance with another embodiment of that patent, the disparate fluids, which may be water and a chemical cleaner concentrate, exiting discharge passages 22, 23 proceed through one-way discharge check valves 24, 25 and then to a mixing manifold 26 mounted to the downstream ends of discharge barrels 19, 21. The disparate fluids discharged through their respective one-way discharge valves enter mixing chamber 27 of the manifold via respective ports 28, 29 provided in an upstream wall 31 of the manifold. The first and second fluids are intimately and thoroughly combined in chamber 27 and issue therefrom as a mixture of fluids through outlet port 32 located in downstream wall 33 of the manifold. The mixture passes into a chamber 34 defined by sleeve 35 mounted on the outer face of wall 33 of the manifold. From there the mixture of the first and second fluids discharges through open inlet port 36 of a nozzle assembly 37 and into a chamber 38 thereof. Such chamber is defined by a pair of spaced walls 39, 41 enclosed by an end wall 42. Inlet port 36 is located in wall 39, and outlet ports 43, 44 are located in front wall 41 of the nozzle assembly, as more clearly shown in FIG. 5. Probes 45 extend from outer wall 41 and are surrounded by support sleeves 46 on the wall 41. Probe 45 is located adjacent each port 43, 44 which opens into the interior of sleeve 46 as shown. The sleeve 46 supports an orifice cup 47 secured thereto and having a discharge orifice 48. The probe extends into a central opening 49 of the cup, the cup having a longitudinal groove 51 opening into its central opening. The probe has a longitudinal groove 52 in communication with groove 51, groove 52 opening into a swirl chamber via tangential grooves 53. Reference is made to U.S. Pat. No. 4,706,888, commonly owned herewith, for details of a spin mechanics assembly provided to effect a swirling action of fluid moving therethrough to issue through the discharge orifice in the form of a spray. Otherwise, the spin mechanics assembly can include tangentials and a swirl chamber on the inner face of the orifice cup confronting the end of a flat tipped probe, without departing from the invention. And, it is to be pointed out that each nozzle which is generally designated 50 in FIG. 5 is representative of the pair of nozzles formed on the outer wall 41 of the nozzle assembly.

Figure 4:
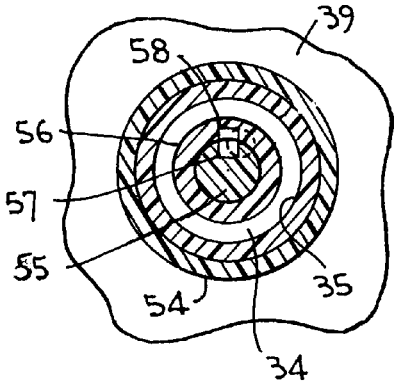
FIG. 4 is a cross-sectional view taken substantially along line 4—4 of FIG. 2.

The nozzle assembly further has a sleeve 54 (FIG. 4) extending from its wall 39 surrounding sleeve 35 and coupled thereto as by a suitable annular ring/groove arrangement acting between the telescoping sleeves. In such manner the nozzle assembly is coupled to the mixing manifold for rotation about its central axis.

A probe 55 may extend from outer wall 33 of the manifold into a sleeve 56 which extends from the back wall 39 of the nozzle assembly. The exterior of the probe has a longitudinal groove 57 and the interior of sleeve 56 has a longitudinal groove 58. In the selected rotative position of the nozzle assembly relative to the manifold shown in FIG. 4, grooves 57 and 58 match thereby opening a passage into inlet port 36 permitting the mixed fluids to flow from the mixing manifold into chamber 38 of the nozzle assembly. In another selected rotative position of the nozzle assembly (not shown), grooves 57, 58 mismatch thereby blocking communication of chamber 34 with inlet port 36 to thereby close the discharge.

In operation, with the pump chambers primed with the respective disparate products to be discharged, upon actuation of the trigger lever 16 which simultaneously reciprocate pistons 15 in their cylinders 17, first and second fluids are pumped through their respective discharge passages 22, 23 through one-way discharge valves 24, 25 and into mixing chamber 27 via inlet ports 28, 29 where the disparate fluids intimately and thoroughly intermix and exit outlet port 32 as a mixture and into chamber 38 of the nozzle assembly via chamber 34 and inlet port 36. This, of course, assumes that the rotatively movable nozzle assembly is selectively rotated into the discharge open position of FIG. 4 with longitudinal grooves 57, 58 matched as shown. In chamber 38 the mixture of first and second fluids are split and channeled into nozzles 50 via outlet ports 43, 44. The mixture of disparate fluids then issue through discharge orifices 48 of the nozzles after passing through the spin mechanics assemblies as aforedescribed at which the mixture at both nozzles are swirled in the swirl chambers thereof. The combined first and second fluids issue as dual sprays through nozzles 50 establishing awareness for the user that different fluids are being discharged yet with the assuredness that the disparate fluids have already been thoroughly mixed prior to discharge. The separate piston/cylinder units and the separate discharge barrels provided for the respective disparate fluids maintain the fluids in separate paths to the mixing manifold such that all the advantages are achieved as with the prior art 5,535,950 patented dual sprayer while at the same time effecting intimate mixing of the first and second fluids prior to discharge as dual sprays of the combined, mixed together fluids. Thus, the shelf life of the chemical fluid, for example, separately stored, is preserved and commingling with the other fluid does not take place until the fluids are combined in the manifold mixing chamber thereby avoiding any separation of fluids over time which would have otherwise been combined prior to discharge within the sprayer.

From the forgoing it can be seen that a simple and efficient yet highly effective dual sprayer has been devised providing for intimate mixing of two different fluids prior to discharge through separate spray nozzles as combined sprays providing the awareness to the user that separate liquids are being discharged.

Obviously, many modifications and variations of the present invention are made possible in the light of the above teachings, for example, the mixing manifold is illustrated in exaggerated form can otherwise be of a thin plate having an internal mixing chamber with inlet ports on its upstream face and an outlet port on its downstream face. The opening and closing of the discharge from the mixing manifold can be effected by any equivalent structure to that shown such as the provision of relatively sliding plates or the like between the mixing manifold and the nozzle assembly which open and close the inlet port to the nozzle assembly upon relative rotation of the parts. And, nozzles 50 which produce sprays can be of any equivalent structure from that shown, without departing from the invention. It is therefore to be understood that within the scope of the appended claims the invention may be practiced otherwise than as specifically described.

What is claimed is:

1. A trigger operated pump dispenser for simultaneously dispensing first and second liquids separately stored in respective first and second liquid compartments, comprising:

a pump body having pump means in fluid communication with said liquid compartments for simultaneous suctioning liquid therefrom and for discharging suctioned fluid to a mixing manifold;

said pump means including a pair of side-by-side pump pistons respectively operating in a pair of side-by-side pump cylinders;

a trigger lever pivotally mounted to said pump body and engaging said pistons for simultaneously reciprocating said pistons upon trigger actuation; and nozzle means in communication with said manifold having a pair of nozzles with discharge orifices for the dual discharge of the fluids combined in the mixing manifold.

2. The pump dispenser according to claim 1, wherein said nozzle means is mounted on a probe extending from said manifold for rotatable movement between discharge open and closed positions, said nozzles having atomizing means for atomizing the discharged combined fluids in the discharge open position.

3. The pump dispenser according to claim 1, wherein said mixing manifold is located at a downstream end of a pair of side-by-side discharge barrels through which the suctioned fluids flow upon trigger actuation.

4. The pump dispenser according to claim 2, wherein the probe extends into a sleeve mounted on the nozzle means cooperating longitudinal grooves on the probe and the sleeve aligning in the discharge open position and misaligning in the discharge closed position upon rotation of the nozzle means.

5. The pump dispenser according to claim 1, wherein said nozzle means includes a housing having a chamber with a single inlet port in communication with said mixing manifold, said housing further having a pair of nozzle passages respectively terminating in a pair of discharge orifices of said nozzles.

6. A trigger operated pump dispenser for simultaneously dispensing first and second fluids separately stored in separate first and second compartments, respectively, comprising:

a pump body having pump means in fluid communication with said compartments for simultaneously suctioning fluids and for discharging suctioned fluid to a mixing manifold;

said pump means including a pair of side-by-side pump pistons operating in a pair of side-by-side pump cylinders defining separate variable volume pump chambers;

a trigger actuator pivotally mounted to said pump body and engaging said piston for simultaneous reciprocation thereof;

said pump chambers respectively communicating with said compartments and with a pair of separate discharge passages located in said pump body;

one-way discharge valve means associated with said discharge passages; and nozzle means mounted in communication with said mixing manifold and having a pair of spray nozzles with discharge orifices through each of which a mixture of the first and second fluids are sprayed toward a target.

7. The pump dispenser according to claim 6, wherein said nozzle means is mounted to said manifold for rotation between discharge open and closed positions.

8. The pump dispenser according to claim 7, wherein said nozzle means and said manifold have mating positions with discharge openings which align to open the discharge in one selected rotative position and which misalign to close the discharge in another selected rotative position.

9. A trigger actuated pump dispenser for simultaneously dispensing first and second fluids from first and second compartments stored separately, comprising:

a pump body having pump means defining separate piston-cylinder units in fluid communication with said fluid compartments for simultaneously suctioning fluid therefrom and for discharging suctioned fluid;

said pump body having a pair of fluid passages respectively through which the first and second fluids are discharged;

a manifold coupled to said passages for the reception of the first and second fluids through one-way discharge valves and for combining the first and second fluids into a combined mixture, the manifold having a single discharge channel for the mixture; and a nozzle on the manifold having a pair of separate spin mechanics assemblies in communication with said discharge channel through which the mixture is simultaneously discharged as spray.

10. The pump dispenser according to claim 9, wherein the nozzle is mounted to the manifold for rotation between discharge open and closed position.

* * * * *